US008766131B2

(12) United States Patent
Mantilla et al.

(10) Patent No.: US 8,766,131 B2
(45) Date of Patent: Jul. 1, 2014

(54) GAS-INSULATED HIGH-VOLTAGE SWITCH

(75) Inventors: Javier Mantilla, Baden (CH); Nicola Gariboldi, Nussbaumen (CH); Stephan Grob, Baden (CH); Oliver Cossalter, Fislisbach (CH); Mathias-Dominic Buergler, Wettingen (CH)

(73) Assignee: ABB Technology AG, Zurich (CH)

( * ) Notice: Subject to any disclaimer, the term of this patent is extended or adjusted under 35 U.S.C. 154(b) by 517 days.

(21) Appl. No.: 13/105,377

(22) Filed: May 11, 2011

(65) Prior Publication Data

US 2011/0278263 A1 Nov. 17, 2011

(30) Foreign Application Priority Data

May 12, 2010 (EP) ..... 10162647

(51) Int. Cl.
*H01H 33/82* (2006.01)

(52) U.S. Cl.
USPC ..... 218/78; 218/140; 218/154

(58) Field of Classification Search
USPC ..... 218/43–54, 57–65, 72, 73
See application file for complete search history.

(56) References Cited

U.S. PATENT DOCUMENTS

| | | | | |
|---|---|---|---|---|
| 4,421,962 | A * | 12/1983 | Thuries et al. | 218/143 |
| 5,155,313 | A | 10/1992 | Dufournet et al. | |
| 5,293,014 | A * | 3/1994 | Perret | 218/57 |
| 5,841,614 | A * | 11/1998 | Perret | 218/143 |

FOREIGN PATENT DOCUMENTS

| | | | |
|---|---|---|---|
| CH | 519238 | | 2/1972 |
| DE | 10125100 | A1 | 11/2002 |
| EP | 0458236 | A1 | 11/1991 |
| GB | 2089572 | A | 6/1982 |

OTHER PUBLICATIONS

European Search Report issued on Oct. 12, 2010, for European Application No. 10162647.1.

* cited by examiner

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A high-voltage switch includes a contact arrangement having two arcing contacts, one of which is supported displaceably against the action of a pretensioned spring. When the contact arrangement is closed, the free ends of the two arcing contacts are supported on one another. When the contact arrangement is opened, the two arcing contacts separate and during this process an arcing zone, accommodating compressed arc gas, is produced which is limited axially by free ends of the two arcing contacts and radially by an insulating nozzle toward the outside. To prevent the displaceably supported arcing contact from returning against the action of the pretensioned spring when a large short-circuit current is interrupted, the switch includes a piston/cylinder system functioning as a restoring device, which communicates with the arcing zone and which, with increasing pressure of the compressed arc gas produced in the arcing zone, generates a restoring force supporting the repelling force of the pretensioned spring.

10 Claims, 1 Drawing Sheet

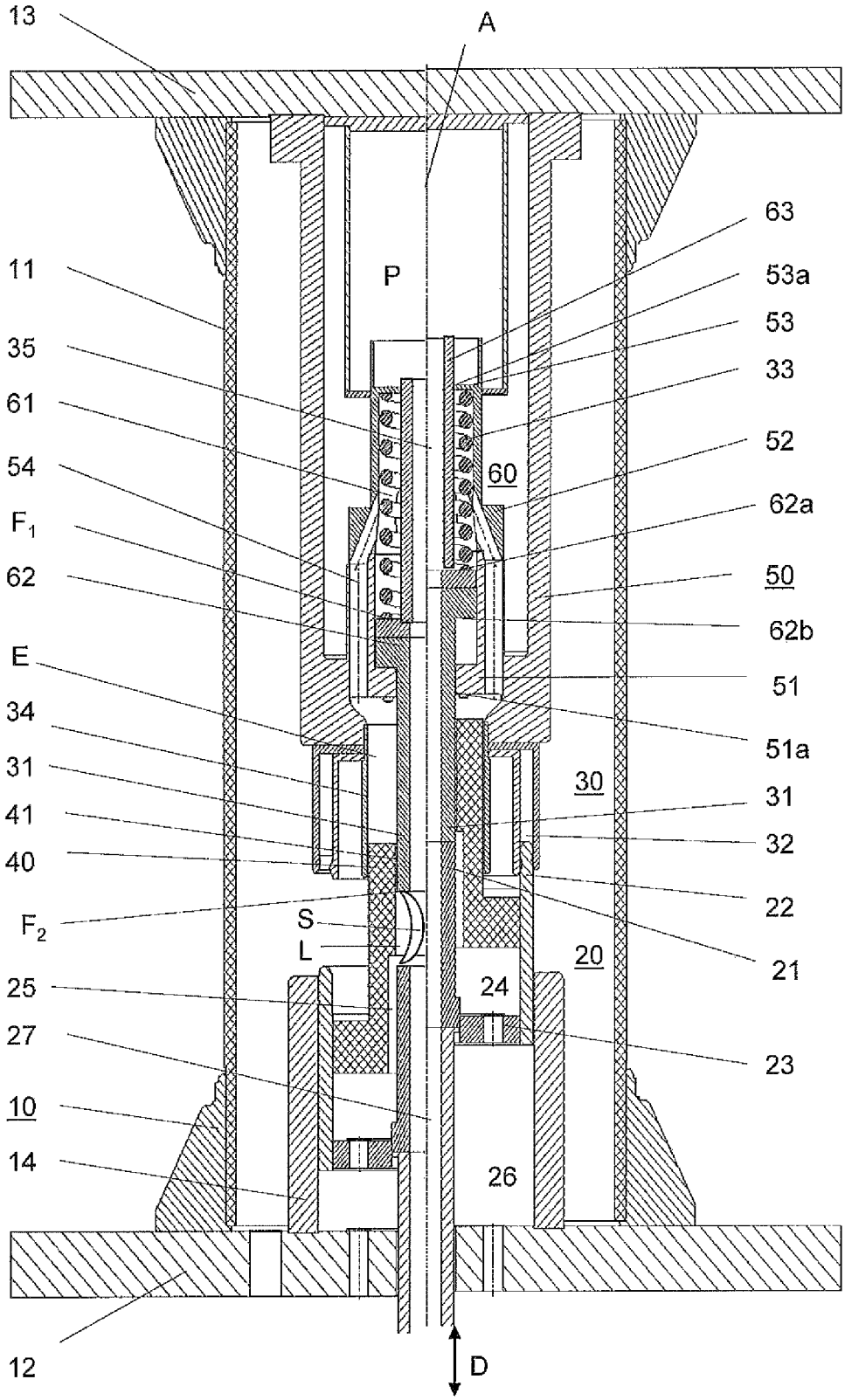
13
A
63
11
P
53a
53
35
33
61
52
60
54
62a
F1
50
62
62b
E
51
34
51a
31
30
31
41
32
40
22
F2
S
L
21
20
25
24
27
23
10
14
26
12
D

GAS-INSULATED HIGH-VOLTAGE SWITCH

RELATED APPLICATION

This application claims priority under 35 U.S.C. §119 to European Patent Application No. 10162647.1 filed in Europe on May 12, 2010, the entire content of which is hereby incorporated by reference in its entirety.

FIELD

The present disclosure relates to a high-voltage switch.

Such a high-voltage switches are constructed as circuit breakers and have a nominal current carrying capacity of at least some kA in the voltage range of more than a few kV. In general, these switches are used as generator circuit breakers and therefore contain a contact arrangement which can be loaded with high nominal currents, having two contact members, which in each case contain one nominal-current contact and one arcing contact. An insulating nozzle is attached on a first one of the contact members. The arcing contact of the second contact member is supported axially displaceably against the action of a pretensioned spring in a fixed contact carrier. When the contact arrangement is closed, free ends of the two arcing contacts are supported on one another, forming a contact force generated by the pretensioned spring. When the contact arrangement is opened, the two arcing contacts only separate from one another after a predetermined travel of the contact members. During this process, an arcing zone accommodating compressed arc gas is produced, which is bounded axially by the free ends of the two arcing contacts, and radially by the insulating nozzle toward the outside.

BACKGROUND INFORMATION

A switch of the aforementioned type is described in CH 519238. This switch has a case which is filled with an insulating gas exhibiting arc quenching characteristics and accommodates a contact arrangement which includes two contact members which can be moved relatively with respect to one another along an axis. The two contact members have in each case one nominal-current contact and one arcing contact constructed as nozzle tube. A first one, which can be moved by a drive, of the two contact members carries an insulating nozzle through which the arcing contact of the second contact member is conducted when the switch is closed. This arcing contact is constructed as a follow-up contact and is loaded with a pretensioned spring. When the switch is closed, the follow-up contact is supported with its free end facing away from the spring, forming an adequate contact force, on the free end of the arcing contact, facing away from the drive, of the first contact member. On switch-off, the pretensioned spring follows the first contact member with the follow-up contact over a defined distance, as a result of which the travel of the first contact member is kept small and, in addition, drive energy is saved in the initial phase of the switching-off process as compared with a switch in which both arcing contacts overlap with friction lock.

SUMMARY

An exemplary embodiment of the present disclosure provides a gas-insulated high-voltage switch. The exemplary gas-insulated high-voltage switch includes a contact arrangement having a first contact member and a second contact member configured to be moved relative to one another along an axis. Each of the contact members respectively include an arcing contact. The exemplary gas-insulated high-voltage switch also includes a pretensioned spring, and an insulating nozzle attached at the first contact members. The arcing contact of the second contact member is supported axially displaceably against the pretensioned spring. When the contact arrangement is closed, free ends of the two arcing contacts are configured to be supported on one another to form a contact force generated by the pretensioned spring. The two arcing contacts, when the contact arrangement is opened, are configured to separate from one another, and while the contacts arrangements separate from one another, an arcing zone, which accommodates compressed arc gas, is produced which is delimited axially by the free ends of the two arcing contacts and radially by the insulating nozzle toward outside of the switch. The second contact member includes a piston/cylinder system constituting a restoring device which communicates with the arcing zone and which, with increasing pressure of the compressed arc gas produced in the arcing zone, is configured to generate a restoring force supporting the repelling force of the pretensioned spring.

BRIEF DESCRIPTION OF THE DRAWING

Additional refinements, advantages and features of the present disclosure are described in more detail below with reference to exemplary embodiments illustrated in the drawings, in which:

The drawing shows a top view of a section, conducted along an axis A, through an exemplary embodiment of a high-voltage switch according to the present disclosure which is illustrated during the interruption of a high short-circuit current in the part of the FIGURE located to the left of the axis and in the switched-on state in the part located to the right of the axis.

The reference designations used in the drawing, and their significance, are listed summarized in the list of reference designations. In principle, identical or identically acting parts are provided with identical or similar reference designations in the drawing. The exemplary embodiment described serves as an example for the subject matter of the disclosure and does not have any restrictive effect.

DETAILED DESCRIPTION

Exemplary embodiments of the present disclosure provide a gas-insulated high-voltage which only needs little operating energy and nevertheless is characterized by great reliability and a long service life.

According to an exemplary embodiment, the gas-insulated high-voltage switch contains a contact arrangement which has two contact members, which can be moved relative to one another along an axis. Each of the contact members have one arcing contact. An insulating nozzle is attached at a first one of the two contact members. In this switch, the arcing contact of the second contact member is supported axially displaceably against the action of a pretensioned spring. When the contact arrangement is closed, free ends of the two arcing contacts are supported on one another, forming a contact force generated by the pretensioned spring. The two arcing contacts separate from one another when the contact arrangement is opened, and during this process, an arcing zone accommodating compressed arc gas is produced which is bounded axially by the free ends of the two arcing contacts and radially by the insulating nozzle toward the outside. The second contact member includes a piston/cylinder system functioning as a restoring device which communicates with arcing zone and which, with increasing pressure of the compressed arc gas produced in the arcing zone, generates a restoring force supporting the repelling force of the pretensioned spring. The repelling force and the restoring force act in the same direction. Both forces therefore act like a harder spring, that is to say as if the pretensioned spring had a greater spring constant.

Due to the fact that the arcing zone communicates with the piston cylinder system, a part of the arc gas which is formed when the arcing contacts are separated by the switching arc is conducted out of the arcing zone to the piston/cylinder system. Thus, a restoring force is built up in the piston/cylinder system due to the pressure of gas flowing in from the arcing zone. This restoring force is directed out of the arcing zone against the direction of movement of the arcing contact. At the beginning of a switching-off process, therefore, the distance between the two arcing contacts remains relatively small and it is prevented that a high arc voltage can become built up and this voltage can result in a high energy exchange in the switching arc. When a large, especially asymmetric short-circuit current is interrupted, excessive contact erosion and strong contamination of the arc gas due to a large energy exchange in the switching arc are thus avoided at the beginning of the interrupting process. Compared with a comparable switch according to known techniques, the reliability and the service life of the switch according to the present disclosure are thus considerably improved.

The stiffness of the spring can be kept relatively small since the piston/cylinder system supports the pretensioning force of the spring during the switching-off of a large short-circuit current. When the switch is closed, an undesirably strong contact bounce is thus avoided which would occur when a spring with high stiffness is used. Apart from the arcing contact of the second contact member, no further moving parts are needed in the switch according to the present disclosure if the piston/cylinder system contains a compression space communicating with the arcing zone which is bounded by a first end face of a piston of the piston/cylinder system and if a second end face of the piston facing away from the compression space is connected rigidly to the arcing contact, having a smaller diameter than the piston, of the second contact member.

To prevent arc gas from penetrating into a volume, separated from the compression space by the piston, of the piston/cylinder system, the arcing contact of the second contact member is conducted through a wall section, shielding the second end face of the piston from the arc gas, of a contact carrier.

A compact construction of the switch according to the present disclosure is ensured if at the wall section of the contact carrier a hollow cylinder, limiting the compression space radially toward the outside of the piston/cylinder system, is held.

In order to bound the compression space radially toward the inside by simple means, an exemplary embodiment provides for the attachment of a piston rod to the first end face bounding the compression space axially and to mold into the arcing contact of the second contact member, the piston and the piston rod an exhaust duct conducted axially through the compression space, which connects the arcing zone with an exhaust space of the switch. This piston rod can be conducted axially displaceably through a bottom of the hollow cylinder bounding the compression space axially.

The pretensioned spring can be arranged in the compression space and supported with one end on the first end face of the piston and with the opposite end on the cylinder bottom.

According to an exemplary embodiment, the arcing zone is connected to the compression space via an annularly constructed expansion space. The hot arc gas formed in the arcing zone expands on its way to the compression space initially adiabatically into this expansion space. During this process, it cools off and emerges into the compression space with a comparatively low temperature. This low temperature contributes to the spring arranged generally in the compression space not exhibiting any relaxation.

The wall of the expansion space can be formed radially outwardly by a sleeve used as longitudinal guide of the insulating nozzle, held on the contact carrier, and radially inwardly by the arcing contact of the second contact member. The expansion space can be connected to the arcing zone via an annular gap which is arranged between the insulating nozzle and the arcing contact of the second contact member and communicate via at least one duct with the compression space, the duct being conducted through the wall section of the contact carrier and the hollow cylinder.

The drawing shows a top view of a section, conducted along an axis A, through an exemplary embodiment of a high-voltage switch according to the present disclosure which is illustrated during the interruption of a high short-circuit current in the part of the FIGURE located to the left of the axis and in the switched-on state in the part located to the right of the axis. The exemplary high-voltage switch shown in the drawing is constructed as a generator circuit breaker. The exemplary high-voltage switch can be designed for a nominal voltage of 24 kV, a nominal current of 6.3 kA, a permissible short-circuit current of 63 kA, and a nominal frequency of 50/60 Hertz, for example. This breaker includes a case 10 which is filled with an insulating gas exhibiting arc quenching characteristics. For example, the insulating gas can be based on sulfur hexafluoride and/or nitrogen and/or carbon dioxide, of generally up to a few bar of pressure. The case 10 shown in the drawing includes a hollow cylindrical insulator 11 and two metal plates 12, 13, which are used in each case as current terminal, between which the insulator 11 is flanged in a gas-tight manner. In the case 10, a contact arrangement connected electrically conductively to the current terminals 12, 13 is provided which includes two contact members 20 and 30 which can be moved relative to one another along an axis A. The contact member 20 is connected to a drive, and is conducted upward along axis A when closing and downward along axis A when opening, as indicated by a double arrow D.

The contact member 20 includes, in an axially symmetric arrangement, a tubular arcing contact 21 and a nominal-current contact 22 surrounding the tubular arcing contact 21 at a distance. The contact member 30 contains in an axially symmetric arrangement a tubularly constructed arcing contact 31 and a nominal-current contact 32, surrounding the arcing contact 31 at a distance, which comprises an outer ring and an inner ring of contact fingers and therefore promotes the transmission of high nominal currents. The arcing contact 31 is supported to be displaceable along the axis A with respect to the nominal-current contact 32 and is supported with its arc-resiliently constructed free end with the aid of a pretensioned spring 33, forming an adequate contact force on the free end, also constructed arc-resiliently, of the arcing contact 21 when the switch is closed (right-hand half of the drawing).

At the contact member 20, the arcing contact 21 and the nominal-current contact 22 are electrically conductively connected via a radially extending wall 23. An insulating nozzle 40, containing PTFE, for example, is attached at the contact member 20 and is arranged between the arcing contact 21 and the nominal-current contact 22 and protrudes past their free ends. The arcing contact 21 and the nominal-current contact 22 are electrically conductively connected via a radially extending wall 23 and, together with the wall 23 and the nozzle 40, delimit a heating volume 24 which, when the breaker is opened (left-hand half of the drawing), communicates with an arcing zone L which accommodates a switching arc S and which is delimited axially by the free ends of the two arcing contacts 21, 31, facing one another, and radially by the insulating nozzle 40 toward the outside. The heating volume 24 is used for accommodating compressed arc gas which is formed by the switching arc S in the arcing zone when the breaker opens and is supplied via a heating duct 25.

The contact member 20 is carried in a gas-tight sliding manner along axis A and electrically conductively in a stationary hollow metal cylinder 14. The hollow cylinder is attached electrically conductively to the plate 12 used as current terminal. The hollow cylinder 14 and a central section of the plate 12 form a stationary cylinder of a piston/cylinder compression device with a compression space 26. Insulating gas located in the compression space 26 is compressed with the aid of the contact member 20 and then conducted downward acting as piston, when the breaker is opened. If the gas pressure in the heating volume 24 is less than in the compression space 26, the compressed insulating gas is conducted out of the compression space 26 into the heating volume 24.

The contact member 30 includes a contact carrier 50 constructed in the form of a pot. The contact carrier is attached at its end acting as rim of the pot electrically conductively to the metal plate 13 acting as current terminal. A wall section 51, acting as bottom of the pot, of the contact carrier 50 includes a central opening 51*a* and carries a hollow cylinder 52, arranged in the interior of the pot, surrounding the central opening coaxially. Into the end part, facing away from the wall section 51, of the hollow cylinder 52, a radially inwardly extending cylinder bottom 53 is integrated into which a central opening 53*a* is molded. In the outer edge area of the wall section 51, the nominal-current contact 32 and a sleeve 34 are electrically conductively attached in a coaxial arrangement, where the nominal-current contact 32 is provided on the outside while the sleeve 34 is provided in the inside.

The hollow cylinder 52 is part of a piston/cylinder system 60 which includes a compression space 61 communicating with the arcing zone L. This compression space is delimited in the axial direction by the cylinder bottom 53 and by an end face 62*a* of a piston 62 carried in the hollow cylinder 52. In the radial direction, it is delimited toward the outside by the hollow cylinder 52 and toward the inside by a piston rod 63 mounted on the end face 62*a*. The piston rod is carried through the opening 53*a* into an exhaust space P of the breaker which communicates with the interior of the case 10 via openings. The piston 62 is rigidly connected at its end face 62*b* facing away from the compression space 61 to the arcing contact 31 having a smaller diameter than the piston 62. The arcing contact 31 is carried through the opening 51*a* out of the space enclosed by the hollow cylinder 52. The wall section 51 therefore shields the end face 62*b* from arc gas which expands through the insulating nozzle 40. Into the arcing contact 31, the piston 62 and the piston rod 63, an exhaust duct 35 conducted axially through the compression space 61, exhibiting a nozzle function, is molded which connects the arcing zone L with the exhaust space P of the breaker.

The pretensioned spring 33 is arranged in the compression space 61 and is supported with its lower end on the end face 62*a* and with the opposite upper end on the cylinder bottom 53, forming the contact force.

The reference symbol E designates an expansion space, the wall of which is formed radially outwardly by the sleeve 34 and radially inwardly by the arcing contact 31. The bottom of the expansion space is formed by the insulating nozzle 40, and the ceiling is formed by the wall section 51. The expansion space E is connected via an annular gap 41, which is delimited radially outwardly by the insulating nozzle 40 and radially inwardly by the arcing contact 31, to the arcing zone L. Ducts 54 carried in the wall section 51 of the contact carrier 50 and in the hollow cylinder 52 connect the expansion space E with the compression space 61.

When the breaker is closed, the current is predominantly conducted from the terminal 12 via the hollow cylinder 14, a sliding contact, the nominal-current contacts 22, 32 and the contact carrier 50 to the terminal 13. When a short-circuit current is switched off, the drive D conducts the contact member 20 downward. During this process, the arcing contact 31, supported on the arcing contact 21 in the switched-on position (right-hand half of the drawing), is caused to follow by the pretensioned contact spring 33, maintaining the required contact force. This contact force is still present even after the separation of the nominal-current contacts 22, 32, and after commutation of the current into a current path containing the connecting wall 23, the arcing contacts 21, 31, a sliding contact, and the wall section 51. As soon as the end face 62*b* of the piston abuts the wall section 51, the two arcing contacts 21, 31 separate and a switching arc S forms between the mutually opposite free ends of the arcing contacts 21, 31. The arc S generates hot gas which is under pressure, which, on the one hand, expands into the heating volume 24 via the heating duct 25 and, on the other hand, passes via the exhaust duct 35, and an exhaust duct 27 molded into the arcing contact 21 exhibiting a nozzle function, into the interior of the case 10. When a zero transition of the current to be switched off is approached, the gas stored in the heating volume 24 blows onto the arc S, supported by compressed insulating gas from the compression space 26, which leads to the current being interrupted.

When a large, for example, asymmetric short-circuit current is switched off, a particularly high gas pressure occurs in the arcing zone L which loads the arcing contact 31 with a force acting in opposition to the pretensioned spring 33. At the same time, the two arcing contacts 21, 31 become repelled due to strong electrodynamic forces. A considerable counterforce therefore acts on the pretensioned spring 33 when such a short-circuit current is switched off. In order to prevent the contact 31 from being carried back upward in opposition to the movement of the contact member 20 and in opposition to the force of the spring 33 when an asymmetric short-circuit current is interrupted, a part of the arc gas is conducted out of the arcing zone via the annular gap 41, the expansion space E and the ducts 54 into the compression space 61. This gas builds up a pressure in the compression space 61 which loads the piston 62 and thus also the contact 31 with a restoring force. This restoring force is proportional to the pressure of the arc gas present in the arcing zone L and supports the pretensioning force of the spring 33. An undesirably great distance between the two arcing contacts 21 and 31 and a correspondingly high arc voltage are thus avoided at the beginning of the current interruption. This is because a high arc voltage quite considerably increases the energy converted in the switching arc S and leads to excessive contact erosion and strong gas contamination right at the beginning of the interrupting process, which reduces the reliability and the service life of the breaker drastically.

The flow cross section of the annular gap 41 is significantly smaller than the flow cross section of the expansion space E and that of the flow ducts 54, respectively. For this reason, the arc gas conducted out of the arcing zone L into the compression space 51 expands adiabatically into the expansion space after emergence from the annular gap. As a result, the pressure and the temperature of the arc gas expanding into the expansion space E are reduced. Since the expansion space has adequate gas-tightness due to the sleeve 34 sliding on the outer surface of the insulating nozzle 40 and the arcing contact 31 closing the central opening 51*a*, the predominant part of the cooled arc gas flows from the expansion space E via the ducts 54 into the compression space 61. Although the pressure of the gas conducted into this space is considerably less than the pressure of the arc gas in the arcing zone L, this pressure is still sufficient for preventing the arcing contact 31 from returning. This is achieved by the fact that the restoring force preventing the return is achieved by a piston face $F_1$ acting in the compression space 61 which is clearly greater by a multiple than a piston face $F_2$ loaded oppositely with pressure in the arcing zone L, which is formed by the open end, carrying a root of the switching arc, of the arcing contact 31.

Due to the strong cooling of the arc gas in the expansion space E and due to the comparatively short dwelling time of the cooled arc gas in the compression space 61, the spring 33 does not exhibit any relaxation and can fulfill its functions comprising the following-up and the contacting, without problems. Since the piston/cylinder system 60 acting as restoring device supports the pretensioning force of the spring 33 during the switching-off of a large, particularly asymmetric short-circuit current, the stiffness of the spring can be kept to be relatively small. When the breaker is closed, an undesirably great contact bounce is thus avoided which would occur when a spring with high stiffness is used.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE DESIGNATIONS

10 Case
11 Insulator
12, 13 Metal plates, current terminals
14 Hollow cylinder
20 Contact member
21 Arcing contact
22 Nominal-current contact
23 Connecting wall
24 Heating volume
25 Heating duct
26 Compression space
27 Exhaust duct
30 Contact member
31 Arcing contact
32 Nominal-current contact
33 Contact spring
34 Sleeve
35 Exhaust duct
40 Insulating nozzle
41 Annular gap
50 Contact carrier
51 Wall section of the contact member
51*a* Opening in the wall section
52 Hollow cylinder
53 Cylinder bottom
53*a* Opening in the cylinder bottom
54 Ducts
60 Piston/cylinder system, restoring device
61 Compression space
62 Piston
62*a*, 62*b* End faces of the piston 62
63 Piston rod
A Axis
D Drive
E Expansion space
$F_1$, $F_2$ Pressure-loaded piston faces
L Arcing zone
P Exhaust space
S Switching arc

What is claimed is:

1. A gas-insulated high-voltage switch comprising:

a contact arrangement which includes a first contact member and a second contact member, both of the first and second contact members being movable along an axis, each of the contact members respectively including an arcing contact;

a pretensioned spring; and an insulating nozzle attached at the first contact member, wherein:

the arcing contact of the second contact member is supported axially displaceably against the pretensioned spring;

when the contact arrangement is closed, free ends of the two arcing contacts are configured to be supported on one another to form a contact force generated by the pretensioned spring;

the two arcing contacts, when the contact arrangement is opened, are configured to separate from one another, and while the contacts arrangements separate from one another, an arcing zone, which accommodates compressed arc gas, is produced which is delimited axially by the free ends of the two arcing contacts and radially by the insulating nozzle toward outside of the switch;

the second contact member includes a piston/cylinder system with a compression space constituting a restoring device which communicates with the arcing zone and which, with increasing pressure of the compressed arc gas produced in the arcing zone, is configured to generate a restoring force supporting the repelling force of the pretensioned spring; and the arcing zone is connected to the compression space via an expansion space being annularly constructed around the arcing contact.

2. The switch as claimed in claim 1, wherein the compression space is delimited by a first end face of a piston of the piston/cylinder system, and a second end face of the piston, facing away from the compression space is connected rigidly with the arcing contact, the arcing contact having a smaller diameter than the piston.

3. The switch as claimed in claim 2, wherein the arcing contact of the second contact member is conducted through a wall section, which shields the second end face of the piston from the arc gas, of a contact carrier.

4. The switch as claimed in claim 3, comprising:

a hollow cylinder of the piston/cylinder system is held at the wall section of the contact carrier, wherein the hollow cylinder is configured to limit the compression space radially toward the outside.

5. The switch as claimed in claim 4, comprising:

a piston rod, which is configured to limit the compression space radially toward the inside of the switch, and which is mounted at the first end face, which axially limits the compression space, and an exhaust duct, which is conducted axially through the compression space, and which is molded into the arcing contact of the second contact member, the piston and the piston rod, which connects the arcing zone with an exhaust space of the switch.

6. The switch as claimed in claim 5, wherein the piston rod is conducted axially displaceably through a bottom, which limits the compression space axially, of the hollow cylinder.

7. The switch as claimed in claim 6, wherein the pretensioned spring is arranged in the compression space and is supported on the first end face with one end and on the cylinder bottom with the opposite end.

8. The switch as claimed in claim 1, wherein the wall of the expansion space is formed radially toward the outside by a sleeve used as longitudinal guide of the insulating nozzle, held on the contact carrier, and radially toward the inside by the arcing contact of the second contact member, and wherein the expansion space is connected to the arcing zone via an annular gap which is arranged between the insulating nozzle and the arcing contact of the second contact member, and communicates with the compression space via at least one duct which is conducted through the wall section of the contact carrier and the hollow cylinder.

9. The switch as claimed in claim 5, wherein the arcing zone is connected to the compression space via an annularly constructed expansion space.

10. The switch as claimed in claim 9, wherein the wall of the expansion space is formed radially toward the outside by a sleeve used as longitudinal guide of the insulating nozzle, held on the contact carrier, and radially toward the inside by the arcing contact of the second contact member, and wherein the expansion space is connected to the arcing zone via an annular gap which is arranged between the insulating nozzle and the arcing contact of the second contact member, and communicates with the compression space via at least one duct which is conducted through the wall section of the contact carrier and the hollow cylinder.

* * * * *